US005783732A

United States Patent [19]

Gilligan

[11] Patent Number: 5,783,732

[45] Date of Patent: Jul. 21, 1998

[54] 2:2 MIXED FLUORO-, AND FLUORONITROALKYL ORTHOCARBONATES

[75] Inventor: William H. Gilligan, Ft. Washington, Md.

[73] Assignee: The United States of America as represented by the Secretary of the Navy, Washington, D.C.

[21] Appl. No.: 253,476

[22] Filed: Mar. 30, 1981

[51] Int. Cl.[6] ..... C07G 43/00; C06B 25/00

[52] U.S. Cl. ..... 568/590; 568/594; 149/88

[58] Field of Search ..... 149/88; 260/463; 568/590, 594

[56] References Cited

U.S. PATENT DOCUMENTS 3,306,939 2/1967 Hill ..... 260/644

3,388,147 6/1968 Kamlet et al. ..... 149/88 X 3,784,422 1/1974 Rocklin et al. ..... 149/88 X

*Primary Examiner*—Peter A. Nelson

*Attorney, Agent, or Firm*—John Forrest; Roger D. Johnson

[57] ABSTRACT

2:2 mixed orthocarbonates of the formula $$[RCH_2O]_2C+OCH_2R']_2$$

wherein R≠R' and wherein R and R' are —$C(NO_2)_3$, —$CF(NO_2)_2$, —$CF_2(NO_2)$, —$C(NO_2)_2CH_3$, —$CH(NO_2)CH_3$, —$CH(NO_2)CH_3$, —$CH_2(NO_2)$, —$CF_3$, or —$CF_2CF_3$, and methods of preparation.

Additionally, orthoformates of the formula $$C+OCH_2R]_4$$

wherein R is —$C(NO_2)_2CH_3$, —$CF_2(NO_2)$, —$CH(NO_2)CH_3$, and —$CH_2(NO_2)$, and methods of preparation.

20 Claims, No Drawings

2:2 MIXED FLUORO-, AND FLUORONITROALKYL ORTHOCARBONATES

BACKGROUND OF THE INVENTION

This invention relates to organic orthocarbonates and more particularly to organic orthocarbonates having fluoro-, nitro-, and fluoronitroalkyl groups.

In the early 1950's Marion E. Hill and co-workers at the Naval Ordnance Laboratory (now the Naval Surface Weapons Center, Silver Spring, Md.) found that certain nitroalcohols would react with carbon tetrachloride in the presence of anhydrous ferric chloride to yield symmetrical orthocarbonates. U.S. Pat. No. 3,306,939 entitled, "Orthoesters of 2,2,2-Trinitroethanol," which issued to Marion E. Hill on Feb. 28, 1967, specifically discloses the synthesis of trinitroethyl orthoformate. Additionally, the synthesis works with 2-fluoro-2,2-nitroethanol and 2,2-dinitropropan-1,3-diol. With other nitroalcohols side-reactions predominate and the principal products are the carbonates. Thus for nitroalcohols, the reaction is of very limited synthetic value. However, the reaction has been used to prepare symmetrical fluoroorthocarbonates of the type $[R_FCF_2CH_2O]_4C$ wherein $R_F$ is $R_FCF_2$ and so on. In any case, mixed orthocarbonates can not be prepared by Hill's method.

SUMMARY OF THE INVENTION

Accordingly an object of this invention is to provide a 2:2 mixed fluoro-, nitro-, and fluoronitroalkyl orthocarbonates.

Another object of this invention is to provide a method of synthesizing a 2:2 mixed fluoro-, nitro-, and fluoronitroalkyl orthocarbonates.

A further object of this invention is to provide symmetrical nitroalkyl orthocarbonates which have not previously been available.

These and other objects of this invention are achieved by providing a 2:2 mixed orthocarbonate of the formula $$(RCH_2O)_2C(OCH_2R')_2$$

wherein R≠R' and wherein R and R' are both selected from the group consisting of $—C(NO_2)_3$, $—CF(NO_2)_2$, $—CF_2(NO_2)$, $—(NO_2)_2CH_3$, $—CH(NO_2)CH_3$, $—CH_2(NO_2)$, $—CF_3$, and $—CF_2CF_3$. These compounds are prepared by reacting a dichloroformal of the formula $$[RCH_2O]_2CCl_2$$

with two moles of an alcohol of the formula $$R'CH_2OH,$$

wherein R and R' are defined as above. Another method of synthesis is to form a solution of a thionocarbonate of the formula $$[RCH_2O]_2C{=}S$$

and two mole of an alcohol of the formula $$R'CH_2OH$$

in an inert solvent, and then pass chlorine gas through the solution.

These techniques are also used to synthesis symmetrical nitroalkyl orthocarbonates which have not previously been available. These include compounds of the formula $$C[OCH_2R]_4$$

wherein R is selected from the group consisting of $—C(NO_2)_2CH_3$, $—CF_2(NO_2)$, $—CH(NO_2)CH_3$, and $—CH_2(NO_2)$.

DETAILED DESCRIPTION OF THE PREFERRED EMBODIMENT

The 2:2 mixed orthocarbonates are prepared by reacting a fluoro-, nitro-, or fluoronitroalkyl dichloroformal with an alcohol containing different substituents.

$$(RCH_2O)_2CCl_2 + 2R'CH_2OH \longrightarrow (RCH_2O)_2C(OCH_2R')_2 + 2HCl$$

wherein R≠R' and wherein R and R' can be $—C(NO_2)_3$, $—CF(NO_2)_2$, $—CF_2(NO_2)$, $—C(NO_2)_2CH_3$, $—CH(NO_2)CH_3$, $—CH_2(NO_2)$, $—CF_3$, or $—CF_2CF_3$.

Preferred 2:2 mixed orthocarbonates are bis(2,2,2-trinitroethyl)bis(2-fluoro-2,2-dinitroethyl) orthocarbonate,
bis(2,2,2-trinitroethyl)bis(2,2-difluoro-2-nitroethyl) orthocarbonate,
bis(2,2,2-trinitroethyl)bis(2,2-dinitropropyl)orthocarbonate,
bis(2,2,2-trinitroethyl)bis(2,2,2-trifluoroethyl) orthocarbonate,
bis(2-fluoro-2,2-dinitroethyl)bis(2,2-difluoro-2-nitroethyl) orthocarbonate,
bis(2-fluoro-2,2-dinitroethyl)bis(2,2-dinitropropyl) orthocarbonate,
bis(2-fluoro-2,2-dinitroethyl)bis(2,2,2-trifluoroethyl) orthocarbonate,
bis(2,2-difluoro-2-nitroethyl)bis(2,2-dinitropropyl) orthocarbonate,
bis(2,2-difluoro-2-nitroethyl)bis(2,2,2-trifluoroethyl) orthocarbonate, and
bis(2,2-dinitropropyl)bis(2,2,2-trifluoroethyl) orthocarbonate.

The dichloroformals which may be used include:

bis(2,2,2-trinitroethyl)dichloroformal,
bis(2-fluoro-2,2-dinitroethyl)dichloroformal,
bis(2,2-difluoro-2-nitroethyl)dichloroformal,
bis(2,2-dinitropropyl)dichloroformal,
bis(2-nitropropyl)dichloroformal,
bis(2-nitroethyl)dichloroformal,
bis(2,2,2-trifluoroethyl)dichloroformal, and
bis(2,2,3,3,3-pentafluoropropyl)dichloroformal.

Alcohols which can be used include:

2,2,2-trinitroethanol,
2-fluoro-2,2-dinitroethanol,
2,2-difluoro-2-nitroethanol,
2,2-dinitropropanol,
2-nitropropanol,
2-nitroethanol,
2,2,2-trifluoroethanol, and
2,2,3,3,3-pentafluoropropanol.

Note that two moles of the alcohol are consumed for each mole of the dichloroformal.

The dichloroformal and the alcohol are dissolved in a suitable solvent such as methylene chloride, chloroform, or 1,2-dichloroethane and then heated until the reaction is completed. The temperature can range over wide limits but 45°–70° C. is preferred: suitable reaction rates are obtained in this range. The products are isolated in the usual manner as illustrated by the examples.

Since the dichloroformals are prepared from thionocarbonates, a variation of the method is to pass gaseous chlorine into a solution of a thionocarbonate and an alcohol preferably at 25°–70° C., more preferable at 45°–70° C., and preferably at about 65° C. The thionocarbonate is converted into the dichloroformal in situ which then reacts with the alcohol to form the 2:2 mixed orthocarbonate.

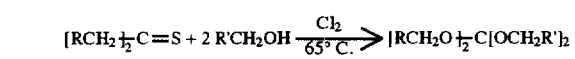

this eliminates the need to isolate the dichloroformal before reaction. Thionocarbonates which may be used in the reaction include:

bis(2,2,2-trinitroethyl)thionocarbonate,
bis(2-fluoro-2,2-dinitroethyl)thionocarbonate,
bis(2,2-difluoro-2-nitroethyl)thionocarbonate,
bis(2,2-dinitropropyl)thionocarbonate,
bis(2-nitropropyl)thionocarbonate,
bis(2-nitroethyl)thionocarbonate,
bis(2,2,2,-trifluoroethyl)thionocarbonate, and
bis(2,2,3,3,3-pentafluoropropyl)thionocarbonate.

The alcohols which may be used are those listed above.

The methods disclosed above can be used to prepare novel symmetrical orthocarbonates by choosing alcohols having the same groups as the thiocarbonates or dichloroformals do:

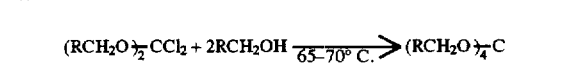

or

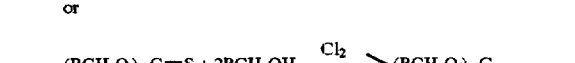

These new symmetrical orthocarbonates include:

tetrakis(2,2-dinitropropyl)orthocarbonate,
tetrakis(2,2-difluoro-nitroethyl)orthocarbonate,
tetrakis(2-nitropropyl)orthocarbonate, and
tetrakis(2-nitroethyl)orthocarbonate.

Methods of preparing the thionocarbonates and the dichloroformals used as starting materials in this invention are disclosed in the U.S. patent application Ser. No. 256,462 entitled "Polynitroethyl Dichloroformals," by William H. Gilligan, filed concurrently with this application, hereby incorporated by reference.

With the exception of bis(3,3,3-trinitroethyl) thionocarbonate, the thionocarbonates are synthesized by reacting one mole of 1,1-thiocarbonyl-di-1,2,4-triazole with two moles of the appropriate alcohol in a chlorinated hydrocarbon solvent or acetone under mild basic conditions at ice bath (0° C.) to room temperature (25° C.) with or without a catalytic amount of pyridine. Bis(3,3,3-trinitroethyl) thionocarbonate is prepared from 1,1'thiocarbonyldil, 2,4-triazole and 2,2,2-trinitroethanol. In this method trifluoroacetic acid is added to tie up the 1,2,4-triazole as it is liberated. This prevents or minimizes the destructive side reactions which would otherwise occur between the 1,2,4-triazole and 2,2,2-trinitroethanol.

The thionocarbonates are converted to the dichloroformals by chlorination with sulfuryl chloride and using a Friedel-Crafts catalyst such as $AlCl_3$ or titanium tetrachloride:

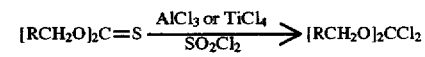

wherein R is $—(NO_2)_3$, $—CF(NO_2)_2$, $—CF_2(NO_2)$, $—C(NO_2)_2CH_3$, $—CH(NO_2)CH_3$, $—CH_2(NOH)$, $—CF_3$, or $—CH_2CF_3$.

In the case of $[CF(NO_2)_2CH_2O]_2CCl_2$, the best yield obtained by this method was 71% using titanium (IV) chloride as catalyst and refluxing for five days. With aluminum chloride as catalyst the reflux time was much shorter but the yields were lower ranging in a number of experiments from 30 to 50% of bis(2-fluoro-2,2-dinitroethyl) dichloroformal.

A preferred method of preparing the halo-, nitro-, and halonitroalkyldichloroformates is to bubble chlorine gas through a stirred mixture of the appropriate thionocarbonate, a chlorinated hydrocarbon and a polar additive (such as trifluoroethanol or acetonitrile) at ambient temperature. In general, the reaction is carried out by making up a 20% (w/v) slurry or solution of the thionocarbonate in a chlorinated hydrocarbon such as carbon tetrachloride, methylene chloride, chloroform, or 1,2-dichloroethane. About 2 moles of polar additive per mole of thionocarbonate are added and chlorine gas is passed through the stirred solution or slurry for from 3 to 8 hours at ambient temperature, after initial cooling.

To more clearly illustrate this invention, the following examples are presented. It should be understood, however, that these examples are presented merely as a means of illustration and are not intended to limit the scope of the invention in any way.

EXAMPLES

Example 1

Bis(2-fluoro-2,2-dinitroethyl)bis(2,2,2-trifluoroethyl)orthocarbonate

A. A solution of 3.89 g (0.01 moles) of bis(2-fluoro-2,2-dinitroethoxy)dichloromethane and 5.12 g (0.05 moles) of 2,2,2-trifluoroethanol were heated in 5 ml of 1,2-dichloroethane at 65° C. for 9 hours. The solution was cooled and the volatiles were removed in vacuo to give 5.14 g (100% yield) of a colorless oil.

B. Gaseous chlorine was slowly passed into a solution of 3.5 g (0.01 moles) of bis(2-fluoro-2,2-dinitroethyl) thionocarbonate and 5.12 g (0.05 moles) of 2,2,2-trifluoroethanol in 5 ml of 1,2-dichloroethane at 65°–67° C. for 10 hours. After cooling the volatiles were removed in vacuo to give 5.17 g (100% yield) of the product. Both products are pure by GLC analysis.

H-NMR ($CDCl_3$/TMS) δ (ppm) –4.75 d, 4H; 4.00 q, 4H. Calc. for $C_9H_8F_8N_4O_{12}$. C, 20.94; H, 1.56; F, 29.45; N, 10.86. Found: C, 21.05; H, 1.55; F, 29.44; N, 11.11.

Example 2

Bis(2-fluoro-2,2-dinitroethyl)bis(2,2-difluoro-2-nitroethyl)orthocarbonate

A solution of 3.89 (0.01 moles) of bis(2-fluoro-2,2-dinitroethyl)dichloroformal and 6.0 g (0.05 moles) of 2,2,2 (trifluoroethanol was heated in 5 ml of 1,2-dichloroethane at 66° C. for 14 hours. After cooling, the reaction solution was taken up in methylene chloride (100 ml) and washed consecutively with 0.1N NaOH (100 ml) and water (100 ml).

The organic phase was dried with anhydrous magnesium sulfate, filtered, and the solvents removed on a rotavac. The solid residue (5.75 g) was recrystallized from chloroform to give 4.05 g (71% yield) of product; mp 85°–86°.

H-NMR ($CDCl_3$TMS) δ (ppm) –4.69 (d, 4H); 4.31 (t,4H). Molecular weight. Calc. 570. Found. 575 (benzene). Calc. for $C_9H_8F_6N_6O_{16}$. C, 18.96; H, 1.41; F, 19.99; N, 14.74. Found: C, 18.89; H, 1.39; F, 19.89; N, 14.53.

Example 3

Bis(2-fluoro-2,2-dinitroethyl)bis(2,2,2-trinitroethyl) orthocarbonate

A solution of 3.89 g (0.01 moles) of bis(2-fluoro-2,2-dinitroethoxy)dichloromethane and 7.24 g (0.04 moles) of 2,2,2-trifluoroethanol was heated in 5 ml of 1,2-dichloroethane for 78 hours. After cooling, the solution was taken up in methylene chloride (75 ml) and washed twice with 100 ml 0.1N sodium hydroxide and five times with 100 ml water. The organic phase was dried ($MgSO_4$), filtered, and the solvents removed in vacuo. The solid residue was recrystallized from chloroform to yield 3.63 g (54%); m.p. 98°–99°.

H-NMR (acetone-$d_6$/TMS) δ (ppm); 5.20 (d, 4H); 5.50 (s, 4H). Calc. for $C_9H_8F_2N_{1024}$. C, 15.94; H, 1.19; F, 5.60; N, 28.65. Found: C, 16.01; H, 1.16; F, 5.49; N, 20.37.

Example 4

Bis(2,2,2-trinitroethyl)bis(2,2,2-trifluoroethyl) orthocarbonate

Gaseous chlorine was passed into a solution of 2.93 g (0.012 moles) of bis(2,2,2-trifluoroethyl)thionocarbonate and 6.80 g (0.038 moles) of 2,2,2-trinitroethanol in 5 ml of 1,2-dichloroethane at 65° C. for 140 minutes. The solution was cooled, and the solvents removed on a rotavac. The residual oil was washed exhaustively with water by decantation to remove excess 2,2,2-trinitroethanol. The oil, after drying, weighed 6.13 g (90% yield). GLC analysis showed one component.

H-NMR ($CDCl_3$/TMS) δ (ppm) –4.92 (s, 4H); 4.04 (q, 4M). Calc. for $C_9H_8F_6N_6O_{16}$. C, 18.96; H, 1.41; F, 19.99; N, 14.74. Found: C, 19.09; H, 1.52; F, 19.85; N, 14.98.

Example 5

Bis(2,2-dinitropropyl)bis(2,2,2-trinitroethyl) orthocarbonate

Gaseous chlorine was passed into a solution of 3.42 g (0.01 moles) of bis(2,2-dinitropropyl)thionocarbonate and 6.80 g (0.038 moles) of 2,2,2-trinitroethanol for 5 hours at 65° C. The volatiles were removed in vacuo and the solid residue was thoroughly washed with water and dried. Recrystallization from chloroform gave 4.67 g (70% yield) of product which melted at 140°–1°. The material was pure by GLC analysis.

H-NMR (acetone, $d_6$/TMS) δ (ppm) –5.48 (s, 4H); 4.74 (s, 4H); 2.33 (s, 6H). Calc. for $C_{11}H_{14}N_{10}O_{14}$. C, 19.71; H, 2.11; N, 20.90. Found C, 19.92; H, 2.15; N, 20.68.

Example 6

Bis(2,2-dinitropropyl)bis(2-fluoro-2,2-dinitroethyl) orthocarbonate.

A solution of 3.89 g (0.01 moles) of bis(2-fluoro-2,2-dinitroethoxy)dichloromethane and 6.0 g (0.04 moles) of 2,2-dinitropropanol was heated in 5 ml of 1,2-dichloroethane for 5 hours at 65° C. The solvents were removed in vacuo and the solid residue was washed thoroughly with water. The residue was dried and recrystallized from chloroform; 4.15 g (67% yield), m.p. 111°–112°. GLC analysis indicates one component.

H-NMR (acetone-$d_6$/TMS) δ (ppm) –5.17 d; 4.73 s; 2.36.5. Calc. for $C_{11}H_{14}F_2N_8O_{20}$. C, 21.44; H, 2.29; F, 6.17; N, 18.18. Found. C, 21.35; H, 2.21; F, 6.13; N, 18.45.

Obviously, many modifications and variations of the present invention are possible in light of the above teachings. It is therefore to be understood that within the scope of the appended claims the invention may be practiced otherwise than as specifically described.

What is claimed as new and desired to be secured by Letters Patent of the United States is:

1. A 2:2 mixed orthocarbonate of the formula $$(RCH_2O\tfrac{1}{2}C\leftarrow OCH_2R')_2$$

wherein (R≠R' and wherein R and R' are selected from the group consisting of —$C(N_2)_3$, —$CF(NO_2)_2$, —$CF_2(NO_2)$, —$C(NO_2)_2CH_3$, —$CH(NO_2)CH_3$, —$CH_2(NO_2)$, —$CF_3$, and —$CF_2F_3$.

2. The 2:2 mixed orthocarbonate of claim 1 wherein R and R' are selected from the group consisting of —$C(NO_2)_3$, —$CF(NO_2)_2$, —$CF_2(NO_2)$, —$C(NO_2)_2CH_3$, and —$CF_3$.

3. The 2:2 mixed orthocarbonate of claim 2 having the formula $$[C(NO_2)_3CH_2O\tfrac{1}{2}C\leftarrow OCH_2CF(NO_2)_2]_2.$$

4. The 2:2 mixed orthocarbonate of claim 2 having the formula $$[C(NO_2)_3CH_2O\tfrac{1}{2}C\leftarrow OCH_2CF_2(NO_2)]_2.$$

5. The 2:2 mixed orthocarbonate of claim 2 having the formula $$[C(NO_2)_3CH_2O\tfrac{1}{2}C\leftarrow OCH_2C(NO_2)_2CH_3]_2.$$

6. The 2:2 mixed orthocarbonate of claim 2 having the formula $$[C(NO_2)_3CH_2O\tfrac{1}{2}C\leftarrow OCH_2CF_3]_2.$$

7. The 2:2 mixed orthocarbonate of claim 2 having the formula $$[CF(NO_2)_2CH_2O\tfrac{1}{2}C\leftarrow OCH_2CF_2(NO_2)]_2.$$

8. The 2:2 mixed orthocarbonate of claim 2 having the formula $$[CF(NO_2)_2CH_2O\tfrac{1}{2}C\leftarrow OCH_2C(NO_2)_2CH_3]_2.$$

9. The 2:2 mixed orthocarbonate of claim 2 having the formula $[CF(NO_2)_2CH_2O\frac{1}{2}C[OCH_2CF_3]_2$.

10. The 2:2 mixed orthocarbonate of claim 2 having the formula $[CF_2(NO_2)CH_2O\frac{1}{2}C+OCH_2C(NO_2)_2CH_3]$.

11. The 2:2 mixed orthocarbonate of claim 2 having the formula $[CF_2(NO_2)CH_2O\frac{1}{2}C[OCH_2CF_3]_2$.

12. The 2:2 mixed orthocarbonate of claim 2 having the formula $[CH_3C(NO_2)_2CH_2O+C[OCH_2CF_3]_2$.

13. An orthocarbonate of the formula $C+OCH_2R]_4$ wherein R is selected from the group consisting of $—C(NO_2)_2CH_3$, $—CF_2(NO_2)$, $—CH(NO_2)CH_3$, and $—CH_2(NO_2)$.

14. The orthocarbonate of claim 13 having the formula $C+OCH_2C(NO_2)_2CH_3]_4$.

15. The orthocarbonate of claim 13 having the formula $C+OCH_2CF_2(NO_2)]_4$.

16. A method of synthesizing a 2:2 mixed orthocarbonate of the formula $[RCH_2O\frac{1}{2}C+OCH_2R']_2$ comprising:

(1) reacting a dichloroformal of the formula $[RCH_2O\frac{1}{2}CCl_2$ with an alcohol of the formula $R'CH_2OH$ wherein R≠R', and R and R' are selected from the group consisting of $—C(NO_2)_3$, $—CF(NO_2)_2$, $—CF_2(NO_2)$, $—C(NO_2)_2CH_3$, $—CH(NO_2)CH_3$, $—CH_2(NO_2)$, $—CF_3$, and $—CF_2CF_3$; and then (2) isolating the product 2:2 a mixed orthocarbonate.

17. The process of claim 16 wherein the reaction temperature is from about 45° C. to about 70° C.

18. A method of synthesizing a 2:2 mixed orthocarbonate of the formula $[RCH_2O\frac{1}{2}C+OCH_2R']_2$ comprising:

(1) forming a solution comprising (a) a thionocarbonate of the formula $[RCH_2O\frac{1}{2}C=S$ (b) an alcohol of the formula $R'CH_2OH$, and (c) an inert organic solvent;

(2) passing chlorine gas through the solution; and (3) isolating the product 2:2 mixed orthocarbonate.

19. The method of claim 18 wherein the reaction temperature is from 25° C. to 70° C.

20. The method of claim 9 wherein the reaction temperature is from 45° C. to 70° C.

* * * * *